US005356063A

United States Patent [19]

Perez

[11] Patent Number: 5,356,063

[45] Date of Patent: Oct. 18, 1994

[54] HAND-OPERATED STAPLER

[75] Inventor: Jorge G. Perez, Barcelona, Spain

[73] Assignee: Erwin Müller GmbH Co., Lingen, Fed. Rep. of Germany

[21] Appl. No.: 39,556

[22] Filed: Mar. 26, 1993

Related U.S. Application Data

[63] Continuation-in-part of Ser. No. 803,177, Dec. 5, 1991, abandoned.

[30] Foreign Application Priority Data

Dec. 5, 1990 [ES] Spain ..... 9003139

[51] Int. Cl.[5] ..... B25C 5/10

[52] U.S. Cl. ..... 227/132; 227/134; 227/146; 227/156

[58] Field of Search ..... 227/132, 134, 127, 128, 227/146, 155, 156

[56] References Cited

U.S. PATENT DOCUMENTS

| | | | |
|---|---|---|---|
| 2,482,993 | 9/1949 | Walker | 227/132 |
| 4,025,031 | 5/1977 | Chi | 227/132 |
| 4,126,260 | 11/1978 | Mickelsson | 227/132 |
| 4,150,774 | 4/1979 | Wright | 227/146 X |
| 4,184,620 | 1/1980 | Ewig | 227/146 X |
| 4,450,998 | 5/1984 | Ruskin | 227/132 X |
| 4,452,388 | 6/1984 | Fealey | 227/132 |
| 4,463,890 | 8/1984 | Ruskin | 227/132 |

*Primary Examiner*—Rinaldi I. Rada
*Assistant Examiner*—Clark F. Dexter
*Attorney, Agent, or Firm*—Herbert L. Lerner; Laurence A. Greenberg

[57] ABSTRACT

A hand-operated stapler, particularly for stapling small stacks of paper or similar objects of paper, includes a base plate having two opposite ends and side parts disposed at one of the ends. A die plate is disposed at the other of the ends. A body is pivotably supported by the side parts. The body has a magazine with a center channel for receiving and guiding a strip of staples and guide ribs disposed substantially at right angles to the center channel. A push blade is guided by the guide ribs for sliding up and down to release and drive in the staples. A top part partly covers the body and acts as an operating arm. A locking and release device for the push blade is operated by the top part. The locking and release device has a pivotable latch being disposed between the top part and the body and is releasably joined to the push blade for intermittently locking the push blade in a locked position relative to a staple in the strip and for releasing the push blade in an unlocked position. The locking and release device has a spring supported on the push blade which is tensed when the unlocked position is attained for effecting a sudden release of the push blade.

5 Claims, 4 Drawing Sheets

HAND-OPERATED STAPLER

This application is a continuation-in-part of application Ser. No. 07/803,177, filed Dec. 5, 1991, now abandoned.

The invention relates to a hand-operated stapler, particularly for stapling small stacks of paper or similar objects of paper, including a base plate having a die plate disposed thereon, a magazine being pivotably supported in side parts on an opposite end of the base plate and being partly covered by a top part acting as an operating arm, the magazine having a center channel for receiving and guiding a staple strip and guide ribs extending substantially at right angles to the center channel for receiving a push blade that slides up and down for releasing and driving in the staples. The invention particularly relates to a mechanism for releasing the individual staples from a strip of staples and driving them into the material to be stapled.

Such hand staplers, which use U-shaped metal staples that may be joined into a strip by being glued together, are already well known. The staplers include:

a) a base plate with a die plate, and side parts for holding purposes on an opposite end, b) a magazine for the staples, having

- a central channel provided as a delivery rail for receiving and guiding the strip of staples until a single staple at the beginning of the strip has reached its release position;
- a release rail, which is located above a release position of the delivery rail and is disposed substantially at right angles thereto;
- a push blade being vertically movably disposed in the release rail, for separating a staple located on the end of the strip of staples during its downward motion, for driving the staple into material to be stapled, and for pressing on the staple until the ends of the staple are permanently or durably deformed by the die plate; and c) a top part partly covering the magazine and serving as an operating arm, being pressed downward by the user of the stapler and as a result transmitting force to the magazine and the push blade, with the magazine and the top part being movably mounted on a common shaft retained by the side parts of the base plate.

In staplers of this generic type, the stapling operation, which is based on the downward motion of the top part and of the magazine, proceeds in a number of sequentially performed individual steps:

1. Downward motion of the top part joined to the magazine, until the magazine touches the material to be stapled.
2. Release of the individual staples from the strip of staples by the push blade and onward motion of the separated staples until they contact the material to be stapled.
3. Penetration of the ends of the staples into the material to be stapled, and the material being pierced through.
4. Bending the ends of the staples over on the back of the material being stapled, by pressure against the die plate of the base plate.

Depending on the type of staples, the way in which they are joined to the strip of staples and the type and thickness of material to be stapled, variously high peaks of force in the various work steps are distinguishable.

During the operation of a conventional stapler with a die plate, such peaks of force lead to the following problems for the user:

1. A variously strong force, which increases in pulsed fashion in the last steps of the downward motion, must be brought to bear on the operating arm.
2. The considerable expenditure of force compels the use of the entire palm or even both hands; the variable expenditure of force among the various steps is clearly perceptible; and easy, ergonomically advantageous actuation, for example with only the fingertips of one hand, is impossible.

It is accordingly an object of the invention to provide a hand-operated stapler, which overcomes the hereinaforementioned disadvantages of the heretofore-known devices of this general type and which provides an improved actuating mechanism, which partly automates the function of the stapler and thus reduces the pulsed expenditure of force and finally makes the stapler easier to operate.

In accordance with the basic concept of the invention, this object is attained by providing a locking and release device, associated with the push blade. A latch is subject to spring action and keeps the push blade in a substantially constant position above the staple to be separated, from the conclusion of the stapling process until the beginning of the next stapling process. A spring is secured to the push blade and tenses during the pressing downward of the top part and the gradual unlocking of the push blade by the latch. Through the use of the latch in combination with the spring, the locking and release device effects not only a sudden release of the push blade, which is in the tripping position, toward the staple by spring force, but also the penetration of the staple into the material to be stapled and the bending over of the staple ends.

With the foregoing and other objects in view there is provided, in accordance with the invention, a hand-operated stapler, particularly for stapling small stacks of paper or similar objects of paper, comprising a base plate having two opposite ends and side parts disposed at one of the ends, a die plate disposed at the other of the ends, a body pivotably supported by the side parts, the body including a magazine having a center channel for receiving and guiding a strip of staples, the body having guide ribs extending substantially at right angles to the center channel, a push blade being guided or received by the guide ribs for sliding up and down to release and drive in the staples, a top part partly covering the body and acting as an operating arm, and a locking and release device for the push blade being operated by the top part, the locking and release device having a pivotable latch being disposed between the top part and the magazine and being releasably joined to the push blade for intermittently locking the push blade in a substantially constant or invariable locking position relative to a staple in the strip and for releasing the push blade in an unlocking position, and the locking and release device having a spring being supported on the push blade and being tensed after the unlocking position is attained for effecting a sudden release of the push blade.

In accordance with another feature of the invention, there are provided guide walls, a shaft supporting the latch between the guide walls, and a torsion spring being operatively connected to the latch and disposed on the shaft for pressing the latch against the push blade.

In accordance with a further feature of the invention, the latch has a side facing toward the push blade and pawls disposed on the side, the pawls corresponding with openings formed in the push blade, and the pawls engaging the openings in the locking position of the push blade under the influence of the torsion spring.

In accordance with an added feature of the invention, there is provided a catch disposed on a part of the body extending from the magazine, and pins engaging the top part, the spring being a coiled leg spring having one leg supported in an opening formed in the push blade, another leg secured in the catch, and a spring coil retained on the top part by the pins.

In accordance with an additional feature of the invention, the latch has a free end at a given level, and the top part has a protrusion at the given level for gradually pivoting the latch into the unlocking position while simultaneously tensing the spring.

In accordance with a concomitant feature of the invention, the guide walls have end surfaces, and the push blade has an elongated part protruding past the end surfaces in a neutral position.

In a stapler constructed according to the invention, a uniform and reduced force is to be brought to bear by the user. In other words, since the force peaks are absent, particularly in the last working step, it is possible to actuate the stapler solely by the pressure of the fingertips, for example.

Other features which are considered as characteristic for the invention are set forth in the appended claims.

Although the invention is illustrated and described herein as embodied in a hand-operated stapler, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
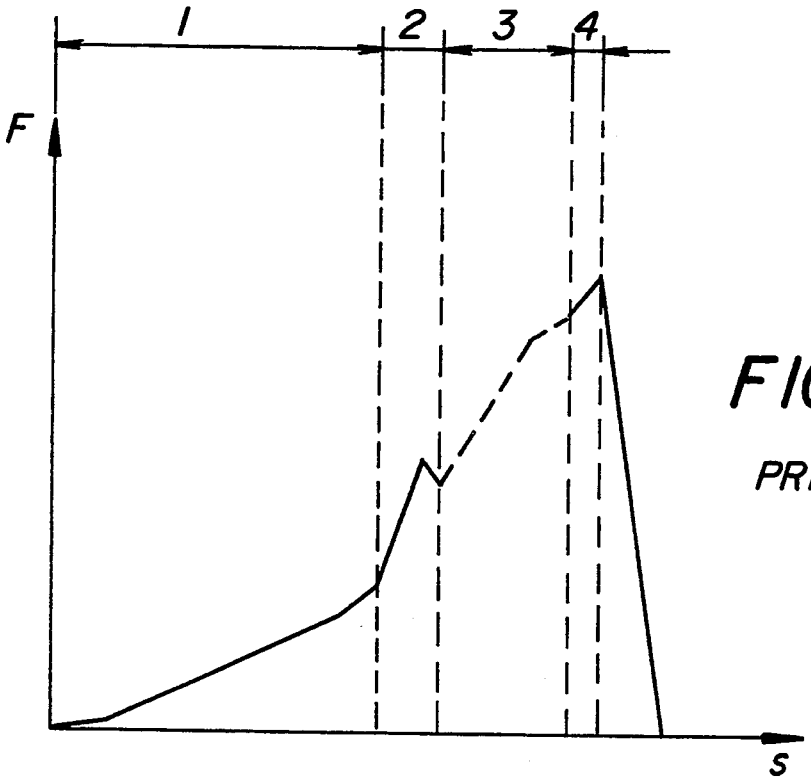
FIG. 1 PRIOR ART
FIG. 1 is a graph in which a force to be brought to bear by a user in stapling with a conventional stapler is plotted over distance.

Referring now to the figures of the drawing in detail and first, particularly, to FIG. 1 thereof, there is seen a graph of the necessary expenditure of force for a user, or an exertion of force upon a staple in four actuation steps involved in stapling with a conventional stapler. The steps include:

- a downward motion of an operating arm until it touches a material to be stapled (step 1 );
- a release and downward motion of a single staple until it touches the material to be stapled (step 2);
- a piercing of the material to be stapled (step 3); and
- a bending over of the staple ends on the back of the material being stapled (step 4).

From the typical illustration in FIG. 1 it can be seen that particularly major exertion in terms of force is necessary in some of the actuation steps, if stapling is to performed. The return of the actuating mechanism to the outset or initial position is shown on the right-hand side of the graph in FIG. 1, in the form of a sudden drop in force.

Figure 2:
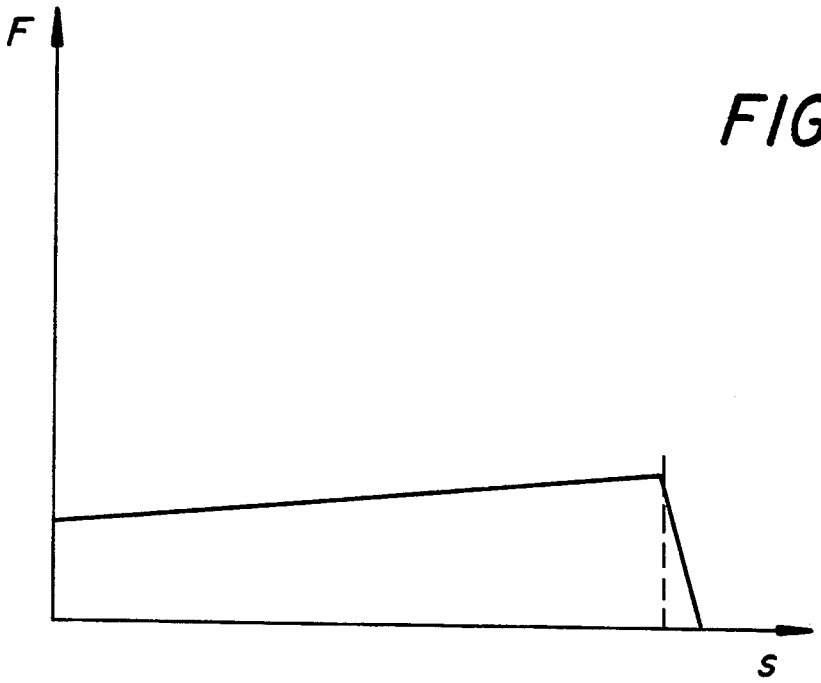
FIG. 2 is a graph in which the force to be brought to bear is plotted over distance for a stapler according to the invention.

In comparison, FIG. 2 clearly shows that the expenditure of force in stapling with a stapler according to the invention is substantially less, and the course of the force is uniform, or in other words it lacks force peaks.

Figure 3:
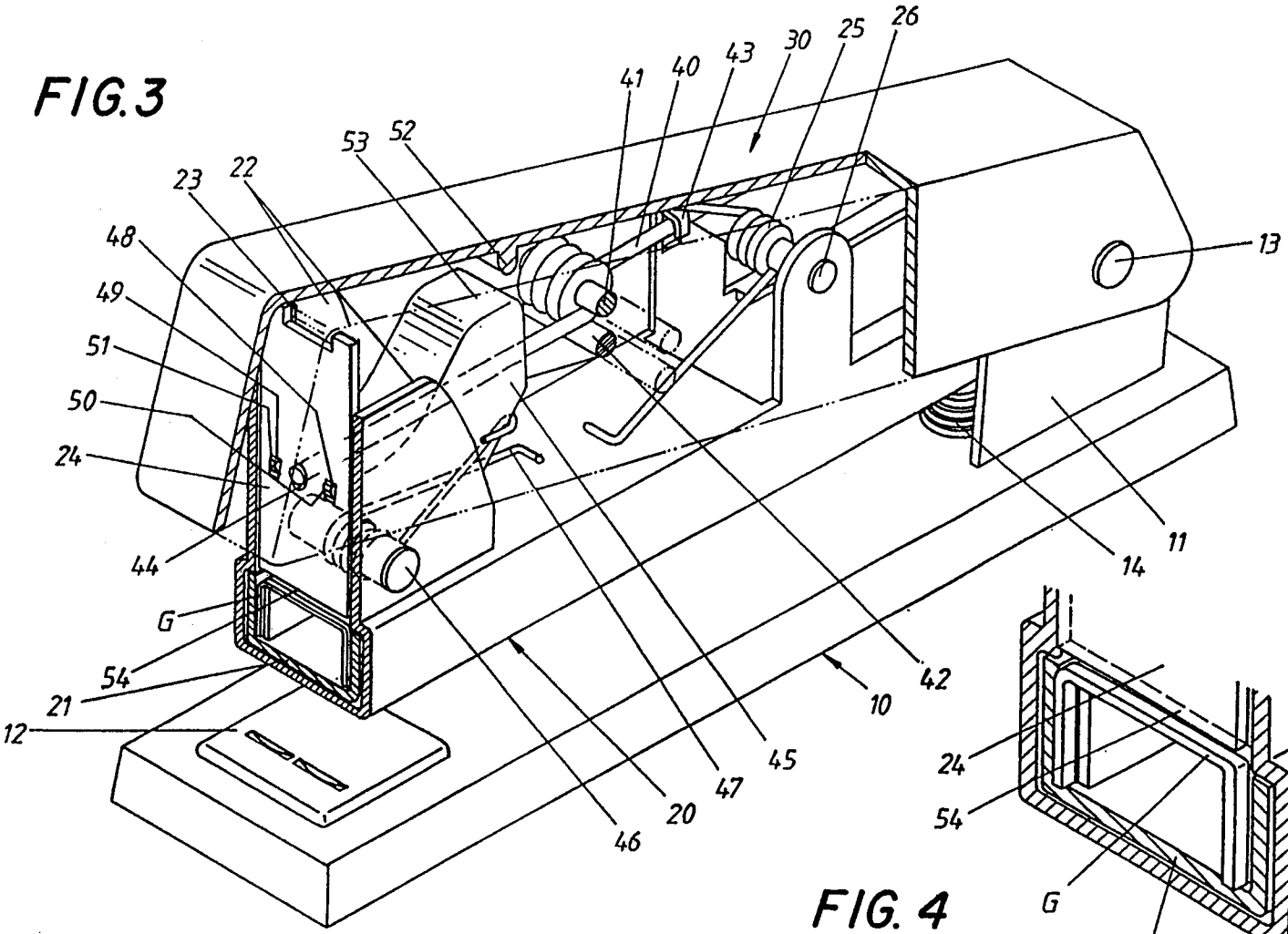
FIG. 3 is a diagrammatic, partly broken-away perspective view of a stapler.
Figure 4:
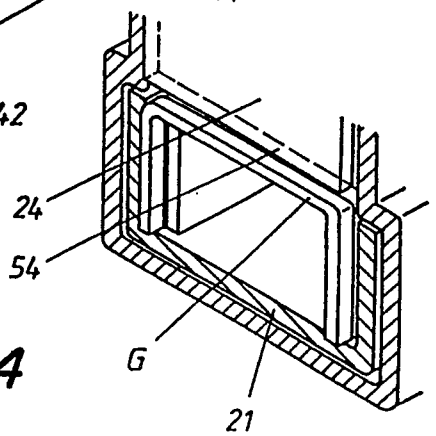
FIG. 4 is a fragmentary, enlarged, perspective view of a portion of FIG. 3.

The stapler which is shown in FIG. 3 and is equipped with the release mechanism according to the invention includes a base plate 10, having one end with side parts 11 and another end which is equipped with a die plate 12. A magazine 20 for receiving staples is joined by a shaft 13 to the side parts 11 of the base plate 10. The magazine 20 includes a center channel 21, which is capable of receiving the strip of staples, of guiding it, and of displacing it into a position from which a single staple G can be separated on the end of the strip.

The magazine 20 is part of a body which includes also has guide walls 22 with guide ribs 23. The guide ribs are located above a release position of the center channel 21 and extend substantially at right angles thereto. The guide ribs receive a vertically displaceable push blade 24 with a lower surface 54, which separates the staple G in the release position from the strip of staples with a downward motion, which drives the staple G into the material to be stapled, and which presses on the staple G until such time as its ends have been permanently deformed by the die plate 12 of the base plate 10.

Disposed above the magazine 20 is a top part 30, which serves to transmit the force expended by the user to the magazine 20 and the push blade 24. A spring 14 is provided between the base plate 10 and the magazine 20 for retracting the magazine after a stapling operation has been completed. A restoring spring 25 for the top part 30 is also disposed between the magazine 20 and the top part 30. In the exemplary embodiment, the restoring spring 25 is wound around a shaft 26.

According to the invention, the stapler is equipped with a release mechanism, including a spring 40 that is secured to the top part 30 with pins 41, 42. A back end of the spring 40 is retained by a catch 43 that is supported by part of the body extending from the magazine 20, and a spring coil is retained by the pin 41. A front end of the spring 40 is supported on the push blade 24 by being disposed in an opening 44 provided in the push blade 24.

According to the invention, a device is also provided for intermittently locking the push blade 24 in the position shown in FIG. 3, in which the lower surface 54 of the push blade 24 is located above the staple G to be separated. In the version shown, this device includes a latch 45, which is secured to the front guide walls 22 extending from the magazine 20 by means of a shaft 46 acting as a hinge. Disposed on the shaft 46 is a torsion spring 47, which has one end that acts against the magazine 20 and another end which acts against the latch 45, so that the torsion spring 47 turns the latch 45 counterclockwise and the latch can then cooperate with the push blade 24. The latch 45 is provided with two pawls 48, 49, which fit into openings 50, 51 provided in the push blade. If the pawls 48, 49 are located in the respective openings 50, 51, they lock the push blade 24 in its upper position above the staple G, regardless of the degree of tension of the spring 40.

The top part 30 is provided with a protrusion 52 that exerts pressure on an upper free end 53 of the latch 45, whenever the top part is moved downward.

The functioning of the locking and release mechanism that is described above in conjunction with FIG. 3 will be described below while referring to FIGS. 5A through 5G, which show various work steps in one complete stapling operation.

Figure 5A:
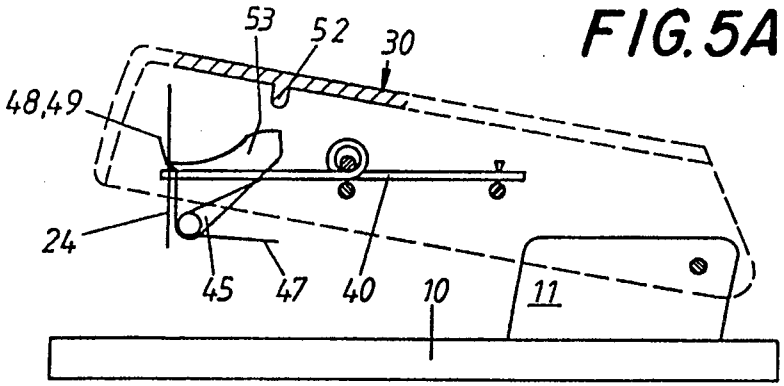
FIGS. 5A through 5G are fragmentary, side-elevational views of various steps in stapling.

In FIG. 5A, the stapler in the position of repose. The spring 40 is not tensed. The pawls 48, 49 of the latch 45, which are tensed by the torsion spring 47, are located in the openings 50, 51 of the push blade 24, so that the push blade is held above the staple G. The protrusion 52 of the top part 30 does not touch the free end 53 of the latch 45.

Figure 5B:
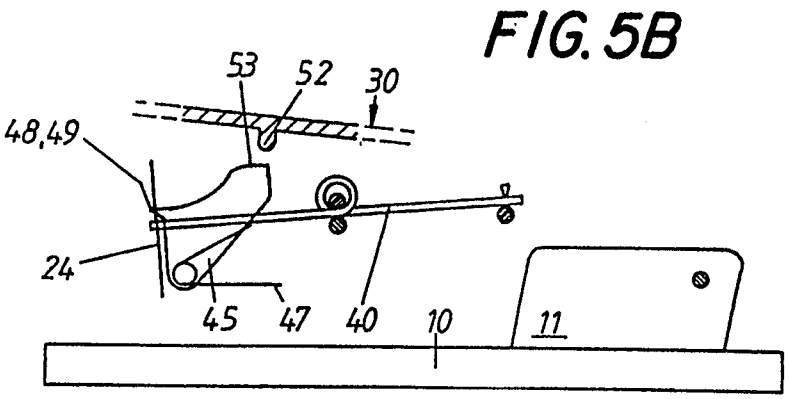

In FIG. 5B, the stapling operation has been initiated by pressure on the front end of the top part 30. Through the use of the restoring spring 25, the top part 30 presses the magazine 20 downward until it rests on the material to be stapled, in a manner which is not shown in FIG. 5B.

Figure 5C:
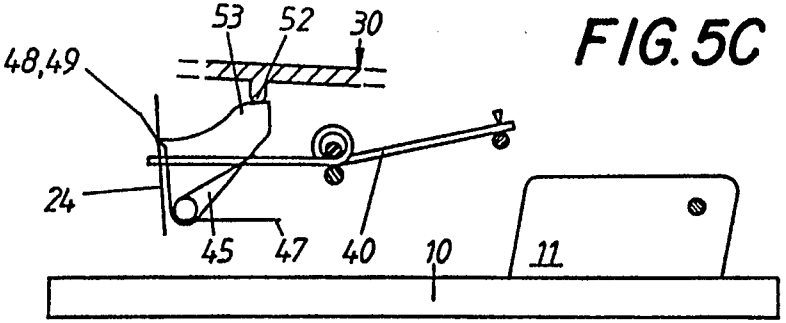
Figure 5D:
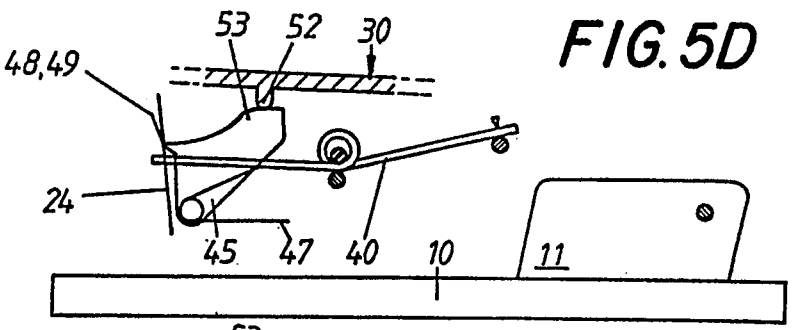

As is shown in FIGS. 5C and 5D, a result of the pressure that continues to be exerted on the top part is that on one hand the spring 40 is tensed and on the other hand the protrusion 52 causes the latch 45 to be rotated about its axis counter to the torsion spring 47, so that the pawls 48, 49 are gradually retracted from the respective openings 50, 51 in the push blade 24.

Figure 5E:
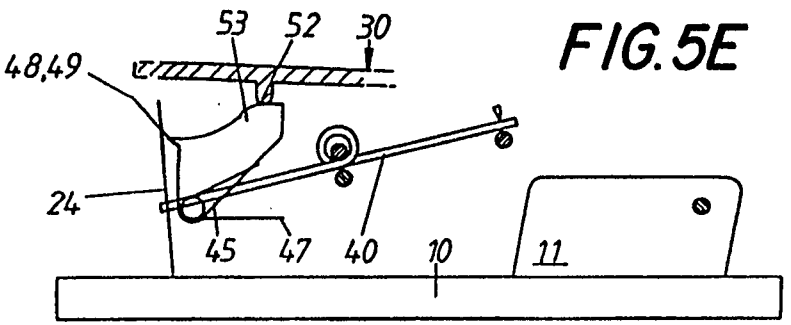

Once the pawls 48, 49 are located entirely outside the openings 50, 51, the push blade is no longer locked, and therefore the spring 40 tends to relax and pushes the push blade abruptly against the staple G, as seen in FIG. 5E. In terms of size, the various parts are constructed in such a way that the energy accumulated in the tensed spring suffices to cause the staple to penetrate the material to be stapled and pierce it through. The ends of the staple G are bent over on the back of the material being stapled, with the aid of the die plate 12.

Figure 5G:
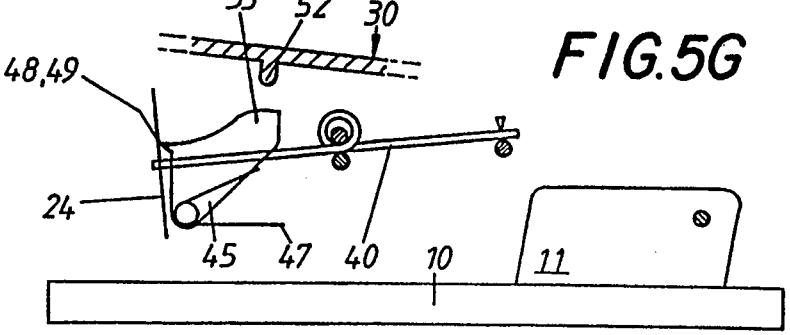
Figure 5F:
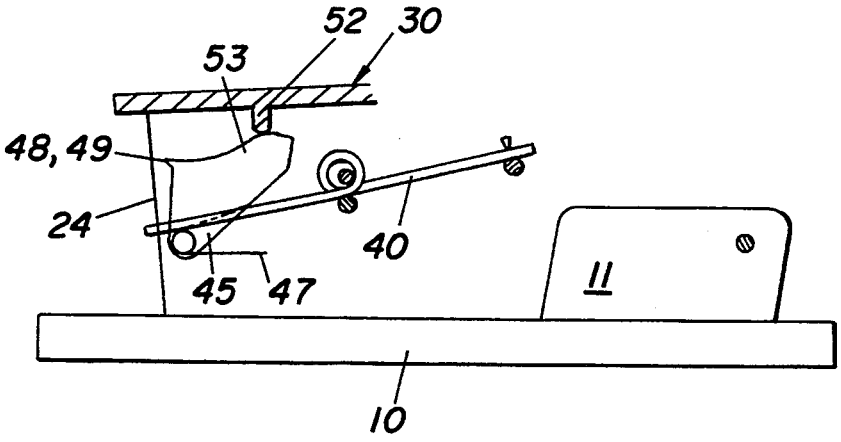

After the staple has been driven, an additional downward force can be applied by the user to the top part 30 which presses against the elongated part of the push blade 24, as seen in FIG. 5F, to further clench the staple G.

Finally, the user of the stapler ceases pressing upon the top part 30, so that the restoring spring 25 returns the top part 30 back to its outset position relative to the magazine 20, as is seen in FIG. 5G. The pawls 48, 49 on the latch 45 snap back into the openings 50, 51 of the push blade and lock it in a position above a new staple G. On the other hand, the magazine 20, which is under the influence of the spring 14, resumes its outset position shown in FIGS. 3 and 5A, so that the stapler is ready for a new stapling operation.

The push blade 24 is held in a substantially fixed position with respect to the staple G to be separated, by means of the latch 45. It maintains this position from the end of the last stapling operation (FIG. 5A) until the tripping of the latch (FIGS. 5D and 5E). The lower surface 54 of the push blade 24 remains in this substantially static locking position above the staple G. The words "substantially static" do not preclude the possibility of minor changes in position of the push blade 24 resulting from deflection and motion of the other parts of the stapler. This is true particularly for the motion of the pawls 48, 49 when they snap into or are retracted from the corresponding openings 50, 51.

The force to be brought to bear in actuating the stapler is limited in practice to tensing the torsion spring 40, since the force necessary to move the restoring spring is negligible. The expenditure of force by the user is entirely independent of the characteristics of the staple, such as the necessary force required to separate the staples from the strip of staples or to deform the ends of the staple.

In FIG. 2, the expenditure of force necessary to move the top part 30 is shown in a graph, and it should be noted that the force to be brought to bear remains virtually constant, in contrast to conventional staplers, as is explained by referring to FIG. 1. In other words, the pulsed course of the force in conventional staplers is not present. In contrast to FIG. 1, the graph of FIG. 2 is not representative for forces acting upon the staples.

The essential advantage of the fact that the force to be brought to bear by the user to actuate the stapler is independent of the force always acting upon the staple according to the invention, is that the various components of the release mechanism of the stapler can be dimensioned for specialized application conditions, for example for heavy or light material to be stapled. This is turn makes it possible to manufacture a stapler for lightweight material to be stapled, in which the spring 40 can be dimensioned to be so light that it is possible to actuate the stapler solely by the pressure of the fingertips of an extended hand. This is impossible in conventional staplers, even when only slight thicknesses of paper are stapled.

In the stapler of the exemplary embodiment, the magazine 20 receives the strip of staples in a sliding rail that is located on the front part of the stapler. However, regardless of the way in which the staples are delivered, the invention can also be used in other staplers of a conventional type, for example staplers in which the staple strips are laid in a fixed (in other words, not removable) delivery rail in the lower part of the magazine after its upper part has been released from the lower part.

The special construction and the disposition of the release mechanism make it possible to attain the aforementioned advantages at minimum expense, since only slight changes are needed to install the release mechanism in conventional staplers. It is a particular advantage that after the latch has been unlocked and the stapling operation has been tripped, it is possible to apply a direct manual force on the push blade.

I claim:

1. A hand-operated stapler, comprising a base plate having two opposite ends, a die plate disposed at one of said ends, a body pivotably supported at the other of said ends, said body including a magazine having a center channel for receiving and guiding a strip of staples, said body having guide ribs extending from said magazine substantially at right angles to a longitudinal axis of said center channel of said magazine, a push blade being guided by said guide ribs for sliding up and down past said center channel from a neutral position to a released position, respectively, to release and drive in a staple from said strip of staples, a top part partly covering said body and acting as an operating arm, and a locking and release device for said push blade being operated by said top part, said locking and release device having a pivotable latch being disposed between said top part and said body and being releasably joined to said push blade in a locked position for temporarily locking said push blade in said neutral position and movable to an unlocked position for releasing said push blade so that said push blade is advanceable to said released position, said locking and release device having a spring supported on said push blade which is tensed when the unlocked position of said latch is attained for effecting a sudden release of said push blade after the unlocked position is attained to drive push blade to said released position, said latch having a free end and said top part having a protrusion disposed in line with said free end, said protrusion being means for gradually pivoting said latch into the unlocked position when said top part is moved toward said body, said body further including a guide wall connected to and extending along each guide rib and having end surfaces, and said push blade having an elongated part protruding past said end surfaces in said neutral and released positions, and means including said elongated part and said top part for an operator to apply additional manual force on said push blade by further depressing said top part after said push blade has been driven by said spring to said released position to further drive in said staple driven from said strip of staples.

2. The hand-operated stapler according to claim 1, including a shaft supporting said latch between said guide walls, and a torsion spring being operatively connected to said latch and disposed on said shaft for pressing said latch against said push blade.

3. The hand-operated stapler according to claim 2, wherein said latch has a front side facing toward said push blade and pawls disposed on said front side, said pawls corresponding with openings formed in said push blade, and said pawls engaging said openings in the locked position of said latch and said neutral position of said push blade under the influence of said torsion spring.

4. The hand-operated stapler according to claim 1, including a catch disposed on said body, and pins engaging said top part, said spring being a coiled leg spring having one leg supported in an opening formed in said push blade, another leg secured in said catch, and a spring coil retained on said top part by said pins.

5. A hand-operated stapler, comprising a base plate, a die plate disposed on said base plate, a body pivotably supported on said base plate, said body including a magazine having a center channel formed therein for receiving strips of staples and guide ribs extending from said magazine substantially perpendicularly relative to a longitudinal axis of said center channel of said magazine, a push blade being guided by said guide ribs for sliding up and down past said center channel from a neutral position to a released position, respectively, for releasing individual staples from the strip of staples and driving in the staples, a top part supported by and disposed above said body and acting as an operating arm, a locking and release device for said push blade, said locking and release device including a spring engaging in said push blade and means for arresting said push blade in said neutral position, said locking and release device being in a locked position while said top part is being depressed and said spring is tensed, said spring being means for suddenly moving said push blade to said released position and driving a staple from said strip of staples when said locking and release device has reached an unlocked position, said locking and release device including a pivotable latch for temporarily locking said push blade, said latch having a free end and said top part having a protrusion cooperating with said free end of said latch for gradually pivoting said latch into the unlocked position, and means including said top part and an elongated part of said push blade, said elongated part protruding past end surfaces of said guide ribs and extending toward said top part in said neutral and released positions, for applying additional force on said push blade by further depressing said top part after driving of the staple by a force applied by said spring on said push blade.

* * * * *